US007886900B2

(12) United States Patent
Weiss et al.

(10) Patent No.: US 7,886,900 B2
(45) Date of Patent: Feb. 15, 2011

(54) TIERED HINGE-LID PACK OF SMOKING ARTICLES

(75) Inventors: Jacques Weiss, Vufflens la Ville (CH); Philippe Bourgoin, Cheseaux (CH); Pierre-Yves Gindrat, Saillon (CH); Miles Richard Hawley, Buckinghamshire (GB); Matthew Rees, Coventry (GB)

(73) Assignee: Philip Morris USA Inc., Richmond, VA (US)

( * ) Notice: Subject to any disclaimer, the term of this patent is extended or adjusted under 35 U.S.C. 154(b) by 237 days.

(21) Appl. No.: 11/633,030

(22) Filed: Dec. 4, 2006

(65) Prior Publication Data

US 2007/0138036 A1 Jun. 21, 2007

(30) Foreign Application Priority Data

Dec. 5, 2005 (EP) ..... 05257478

(51) Int. Cl.
*B65D 85/10* (2006.01)

(52) U.S. Cl. ..... 206/248; 206/268; 206/273; 229/87.13

(58) Field of Classification Search ..... 206/242, 206/248, 256, 268, 271, 273, 740; 229/87.05, 229/87.12, 87.13, 87.14
See application file for complete search history.

(56) References Cited

U.S. PATENT DOCUMENTS 2,100,141 A * 11/1937 Jackson ..... 229/87.13
2,283,856 A * 5/1942 Hoenig ..... 206/264
3,172,530 A * 3/1965 Grabosky et al. ..... 206/747
3,245,525 A * 4/1966 Shoemaker ..... 206/249
4,015,770 A * 4/1977 Tamarin ..... 206/264
4,784,261 A 11/1988 Kutchin
5,121,879 A * 6/1992 Focke et al. ..... 206/264
5,277,304 A 1/1994 Brizzi et al.
5,476,171 A 12/1995 Minarelli et al.
5,584,389 A 12/1996 Focke et al.
5,833,060 A * 11/1998 Draghetti et al. ..... 206/273
6,742,651 B1 6/2004 Focke et al.
2005/0016876 A1 1/2005 Ghini et al.

FOREIGN PATENT DOCUMENTS

EP 0769457 A 4/1997
FR 2597077 A1 10/1987

OTHER PUBLICATIONS

International Search Report and Written Opinion dated Jul. 27, 2007 for PCT/IB2006/004031.

* cited by examiner

*Primary Examiner*—J. Gregory Pickett
(74) *Attorney, Agent, or Firm*—Buchanan Ingersoll & Rooney PC

(57) ABSTRACT

A hinge-lid pack of smoking articles such as cigarettes comprises: a box portion; a lid portion hinged to the box portion; and at least two longitudinally offset tiers of smoking articles mounted in the box portion. Each of the at least two tiers comprises a separately wrapped bundle of smoking articles. In one embodiment, the smoking articles in each of the at least two tiers are of substantially the same length and the upper ends and the lower ends of the separately wrapped bundles of smoking articles are longitudinally offset relative to one another. In another embodiment, the smoking articles in each of the at least two tiers are of different length and the upper ends of the separately wrapped bundles of smoking articles are longitudinally offset relative to one another.

21 Claims, 4 Drawing Sheets

TIERED HINGE-LID PACK OF SMOKING ARTICLES

This application claims priority under 35 U.S.C. §119 to European Application No. 05 257 478.7, filed Dec. 5, 2005, the entire content of which is hereby incorporated by reference.

The present invention relates to a novel hinge-lid pack containing smoking articles such as cigarettes.

Cigarettes are commonly sold in hinge-lid packs having a lower box portion and an upper lid portion that is hinged to the rear wall of the box portion. When the lid portion is closed, the front, side and rear walls thereof form extensions of the corresponding walls of the box portion of the pack. In use, the consumer pivots the lid portion backwards about the hinge to open the pack and so gain access to a wrapped bundle of cigarettes held in the box portion. In order to remove a cigarette from the bundle, the consumer must first pull on the wrapper, which is typically a folded sheet of metal foil or metalize paper, to remove an upper front portion thereof. Consequently, as soon as the consumer removes a single cigarette from the hinge-lid pack, the metal foil or metalized paper wrapper surrounding the bundle ceases to provide the remaining cigarettes therein with any protection against, for example, the egress or ingress of moisture.

Hinge-lid cigarette packs normally also include an inner frame or collar mounted inside the box portion, between the front and sides of the box portion and the wrapped bundle of cigarettes, at least a portion of which projects from the box portion into the space covered by the lid portion in the closed position. To allow the consumer to more readily remove cigarettes from the hinge-lid pack in the open position, a central cut-out is normally provided in the front wall of the inner frame. However, even where a cut-out is provided, close-packing of the cigarettes in the bundle can still make it difficult for a consumer to remove cigarettes from the box portion of the hinge-lid pack, especially when the pack is full. This is the case in, for example, a conventional hinge-lid pack of twenty cigarettes, where the cigarettes making up the bundle are arranged in three parallel rows in a nested 7-6-7 collation.

U.S. Pat. No. 5,277,304 discloses a hinge-lid packet of cigarettes designed to contain more than 20 or 25 cigarettes, which contains two individually wrapped groups of cigarettes and at least one internally anchored collar.

U.S. Pat. No. 6,742,651 discloses a hinge-lid cigarette carton containing a group of hinge-lid cigarette packs.

It would be desirable to provide a hinge-lid pack of cigarettes or other smoking articles that not only affords increased protection and so improved freshness to smoking articles contained therein, but that also allows the consumer easier access to the smoking articles contained therein.

According to the present invention there is provided a hinge lid pack of smoking articles comprising: a lower box portion; an upper lid portion connected to the lower box portion along a hinge line extending across a rear wall of the hinge-lid pack; and at least two longitudinally offset tiers of smoking articles mounted in the lower box portion, wherein each of the at least two tiers comprises a separately wrapped bundle of smoking articles.

Each of the at least two longitudinally offset tiers may comprise more than one row of smoking articles. For example, one or more of the at least two longitudinally offset tiers may comprise two rows of smoking articles.

The number of rows of smoking articles in each of the at least longitudinally offset tiers may be the same or different. For example, a hinge lid pack according to the invention may comprise two longitudinally offset tiers of smoking articles, one tier comprising a single row of smoking articles and the other tier comprising two rows of smoking articles.

Since the consumer only needs to remove a portion of the wrapper surrounding one of the separately wrapped bundles of smoking articles when they wish to remove a smoking article from that particular bundle, the inclusion of at least two separately wrapped bundles of smoking articles advantageously helps to preserve the freshness of smoking articles contained in hinge-lid packs according to the invention after initial opening of the pack by the consumer.

Furthermore, as smoking articles are removed from hinge-lid packs according to the invention by the consumer, the inclusion of at least two separately wrapped bundles of smoking articles also helps to prevent damage to smoking articles remaining in the pack. The separate wrapper around the bundle of smoking articles in each of the at least two tiers advantageously constrains the movement of smoking articles therein, thereby reducing the risk of the smoking articles being damaged through movement within the hinge-lid pack.

In addition, longitudinally offsetting the separately wrapped bundles of elongate smoking articles relative to one another in a tiered arrangement advantageously provides the consumer with improved access to smoking articles contained in hinge-lid packs according to the invention.

In order to longitudinally offset the separately wrapped bundles of smoking articles relative to one another, the base of the lower box portion may be stepped through, for example, the inclusion of a stepped insert. Standing each of the at least two separately wrapped bundles of smoking articles on a different step of the insert, offsets the separately wrapped bundles of smoking articles in height relative to one another, thereby producing the at least two tiers of smoking articles.

Alternatively, in order to produce the at least two tiers of smoking articles, the box portion of the hinge-lid pack may be provided with a sloping bottom wall upon which at least two separately wrapped bundles of smoking articles stand. For example, the lower edge of the front wall of the box portion of hinge-lid packs according to the invention may be offset in height relative to the lower edge of the rear wall thereof, so that a first separately wrapped bundle of smoking articles standing on the bottom wall of the box portion adjacent the front wall thereof is automatically offset in height relative to a second separately wrapped bundle of smoking articles standing on the bottom wall of the box portion adjacent the rear wall thereof.

Preferably, the at least two tiers of smoking articles are formed by affixing at least two separately wrapped bundles of smoking articles to one another in a offset, tiered relationship. The separately wrapped bundles of smoking articles may be affixed to one another using any suitable means, for example, through the application of an adhesive to abutting surfaces of adjacent tiers of smoking articles mounted in the box portion.

Depending on consumer needs, the at least two tiers of smoking articles in hinge-lid packs according to the present invention may advantageously comprise separately wrapped bundles of smoking articles of the same or different types.

Hinge-lid packs of smoking articles according to the invention may, for example, comprise at least two tiers of smoking articles comprising separately wrapped bundles of smoking articles of different size (different length, different circumference or both different length and different circumference). Alternatively, or in addition, hinge-lid packs of smoking articles according to the invention may comprise at least two tiers of smoking articles comprising separately wrapped bundles of smoking articles having different tobacco blends or flavors.

For example, hinge-lid packs of smoking articles according to the present invention may comprise:

one or more tiers comprising a separately wrapped bundle of king size (about 84 mm in length) cigarettes, together with one or more tiers comprising a separately wrapped bundle of shorter (between about 70 mm and about 72 mm in length) cigarettes (i.e. different lengths); or one or more tiers comprising a separately wrapped bundle of king size cigarettes, together with one or more tiers comprising a separately wrapped bundle of slim cigarettes of the same length (i.e. different circumference); or one or more tiers comprising a separately wrapped bundle of higher tar cigarettes, together with one or more tiers comprising a separately wrapped bundle of lower tar cigarettes (i.e. different blends); or one or more tiers comprising a separately wrapped bundle of non-mentholated cigarettes, together with one or more tiers comprising a separately wrapped bundle of menthol cigarettes (i.e. different blends); or one or more tiers comprising a separately wrapped bundle of king size cigarettes, together with one or more tiers comprising a separately wrapped bundle of wider, shorter cigarettes of a different blend (i.e. different circumference, different length and different blend).

It will be appreciated that the specific examples given above are for the purposes of illustration only and that the at least two tiers of smoking articles may comprise other desired combinations of different smoking article types.

Hinge-lid packs of smoking articles according to the present invention may comprise at least two tiers of smoking articles wherein each of the at least two tiers comprises a separately wrapped bundle of smoking articles and the upper ends of the at least two tiers are longitudinally offset relative to one another.

Alternatively, hinge-lid packs of smoking articles according to the present invention may comprise at least two tiers of smoking articles wherein each of the at least two tiers comprises a separately wrapped bundle of smoking articles and the upper ends and the lower ends of the at least two tiers are longitudinally offset relative to one another.

For example, in one embodiment of the invention, the smoking articles in each of the at least two tiers are of substantially the same length and the upper ends and the lower ends of the separately wrapped bundles of smoking articles are longitudinally offset relative to one another.

In another embodiment of the invention, the smoking articles in each of the at least two tiers are of different length and the upper ends of the separately wrapped bundles of smoking articles are longitudinally offset relative to one another.

Where hinge-lid packs of smoking articles according to the present invention comprise at least two tiers of smoking articles comprising separately wrapped bundles of smoking articles of different length, in order to longitudinally offset the upper ends of the at least two tiers relative to one another the box portion of the hinge-lid pack may simply be provided with a non-sloping flat bottom wall upon which the lower ends of the at least two separately wrapped bundles of smoking articles stand. The difference in length of the smoking articles in the separately wrapped bundles then gives rise to a difference in the height of the at least two tiers.

Similarly, the at least two tiers of smoking articles may comprise separately wrapped bundles containing the same number or different numbers s and/or collations of smoking articles.

For example, hinge-lid packs of twenty smoking articles according to the invention may comprise two tiers of smoking articles, wherein one tier comprises a separately wrapped bundle of thirteen cigarettes in a 7-6 collation and the other tier comprises a separately wrapped row of seven smoking articles. Alternatively, hinge-lid packs of twenty smoking articles according to the invention may comprise two tiers of smoking articles, wherein one tier comprises a separately wrapped bundle of smoking articles in a 7-7 collation and the other tier comprises a separately wrapped row of six smoking articles. In yet further embodiments, hinge-lid packs of twenty smoking articles according to the invention may comprise two tiers of smoking articles, wherein one tier comprises a separately wrapped bundle of twelve smoking articles in a 6-6 collation and the other tier comprises a separately wrapped row of eight smoking articles.

A preferred hinge-lid pack of twenty cigarettes according to the invention comprises two tiers of cigarettes, wherein one tier comprises a separately wrapped bundle of thirteen cigarettes of a first type, preferably in a 7-6 collation, and the other tier comprises a separately wrapped row of seven cigarettes of a second, different type. In a particularly preferred embodiment, the first type of cigarettes are king size cigarettes, preferably having a length of 84 mm, and the second type of cigarettes are shorter cigarettes, preferably having a length of about 70 mm.

Preferably, the hinge-lid pack comprises two, three or four tiers of smoking articles. More preferably, the hinge-lid pack comprises two or three tiers of smoking articles.

Where the hinge-lid pack comprises three tiers of smoking articles, preferably each tier of smoking articles comprises a single separately wrapped row of smoking articles.

In one particularly preferred embodiment, the hinge lid pack comprises three tiers of smoking articles each of which comprises a single separately wrapped row of seven smoking articles.

In another particularly preferred embodiment, the hinge lid pack comprises two tiers of smoking articles wherein one tier comprises a single separately wrapped row of seven smoking articles and the other tier comprises a separately wrapped bundle of thirteen smoking articles. Preferably, the thirteen smoking articles are arranged in a 7-6 collation.

The smoking articles may be, for example, cigarettes, cigars or cigarillos. Preferably, the smoking articles are cigarettes.

It will be appreciated that through an appropriate choice of the dimensions thereof, hinge-lid packs according to the invention containing different numbers of conventional size, king size, super-king size, slim or super-slim cigarettes may be produced. Hinge-lid packs of cigarettes according to the invention preferably comprise twenty cigarettes. However, if desired, hinge-lid packs according to the invention comprising more cigarettes, for example, 25 or 30 cigarettes, or fewer cigarettes, for example, 17, 18 or 19 cigarettes, may also be produced.

Preferably, the at least two tiers of smoking articles are fixedly mounted in the lower box portion.

Preferably, the hinge-lid pack further comprises an inner frame mounted in the lower box portion, between the lower box portion and the at least two tiers of smoking articles, at least a portion of which projects from the box portion into space covered by the lid portion in a closed position.

The inner frame may be affixed to one or more of the at least two tiers of smoking articles and/or to the box portion of the hinge-lid container using any suitable means, for example by the application of an adhesive to the surface thereof.

In the absence of an inner frame, one or more of the at least two tiers of smoking articles may be affixed directly to the lower box portion by, for example, the application of a suitable adhesive to the inner surface of the side walls thereof.

Preferably, the hinge-lid pack has an uppermost tier of smoking articles adjacent to a rear wall of the lower box portion and a lowermost tier of smoking articles adjacent to a front wall of the lower box portion.

Preferably, each of the at least two tiers comprises a bundle of smoking articles enveloped in a wrapper having a line of weakness. The line of weakness may be formed by stamping, scoring, perforating, embossing or otherwise compressing, cutting and/or weakening the wrapper. The inclusion of a line of weakness in the wrapper advantageously facilitates removal of a portion thereof by the consumer in order to gain access to smoking articles in the bundle. Preferably, the line of weakness extends circumferentially around an upper region of the separately wrapped bundle of smoking articles. Preferably, the line of weakness in the wrapper enveloping the tier of smoking articles proximate the front wall of the box portion of the hinge-lid pack is not visible to the consumer upon opening the hinge-lid pack.

Preferably, each of the at least two tiers comprises a bundle of smoking articles wrapped in a folded sheet of metal foil or metalized paper.

Preferably, each of the at least two tiers of smoking articles further comprises a tab, more preferably an upstanding tab, affixed to the upper end of the separately wrapped bundle of smoking articles. In use, the consumer may pull on the upstanding tab in order to remove an upper portion of the wrapper from the bundle and so gain access to the smoking articles therein. The upstanding tab thereby advantageously facilitates removal of an upper portion of the wrapper by the consumer.

Preferably, the tab forms part of a label applied over the upper end of the separately wrapped bundle of smoking articles. In this case, the label also advantageously acts as a 'seal' that helps to keep the upper end of the wrapper closed, and so the bundle of smoking articles enveloped therein fresh, until a portion of the wrapper is deliberately removed by the consumer. The application of a label over the upper end of the separately wrapped bundle of smoking articles is particularly preferred where the wrapper is a folded sheet of metal foil, metalized paper or other material.

If desired, the at least two tiers of smoking articles in hinge-lid packs of smoking articles according to the invention may comprise separately wrapped bundles of smoking articles with different wrappers. The wrappers of the separately wrapped bundles of smoking articles in the at least two tiers may, for example, be formed of different base materials, be of different thickness, be different colors and/or have different text, logos or other indicia printed on them.

Alternatively or in addition, in order to distinguish between the at least two tiers of smoking articles, different labels may be applied over the upper ends of the separately wrapped bundles of smoking articles. For example, the separately wrapped bundles of smoking articles may be 'sealed' with labels having different shapes, different colors and/or different text, logos or other indicia printed on them.

Where the at least two tiers of smoking articles in hinge lid packs of smoking articles according to the invention comprise separately wrapped bundles of smoking articles of different types, different wrappers and/or different labels may advantageously be used in order to differentiate between them.

Hinge-lid packs of smoking articles according to the invention may be substantially rectangular parallepipedal in shape, with right-angled longitudinal and right-angled transverse edges. Alternatively, the box portion and/or the lid portion of hinge-lid packs of smoking articles according to the invention may comprise one or more rounded longitudinal edges, rounded transverse edges, bevelled longitudinal edges and/or bevelled transverse edges. For example, by scoring in a known manner a laminar blank from which the box portion and the lid portion of the pack are erected, a "rounded-corner" hinge-lid pack of cigarettes or other smoking articles according to the invention may be produced. Where hinge-lid packs of smoking articles according to the invention have one or more rounded and/or bevelled edges, the overall shape of the hinge-lid pack is preferably such that, in use, the pack can be stood upright on the base of the lower box portion.

The hinge-lid pack may be formed from any suitable materials including, but not limited to, for example cardboard, paperboard, plastic and/or metal. Preferably, the hinge-lid pack is formed from a folded laminar blank, more preferably from a folded laminar cardboard blank.

One or more windows or cut-outs may advantageously be provided in the box portion and/or lid portion of hinge-lid packs of smoking articles according to the present invention in order to enable a consumer to see the at least two tiers of smoking articles housed therein prior to opening of the pack. Preferably, a window or cut-out is provided in a side wall of the hinge-lid pack. If desired, windows or cut-outs may be provided in both side walls of the pack.

The provision of at least one window or cut-out is particularly preferred where hinge-lid packs of smoking articles according to invention having substantially the same external appearance as conventional hinge-lid packs of cigarettes.

Hinge-lid packs of smoking articles according to the invention may be shrink wrapped or otherwise over wrapped with a transparent polymeric film of, for example, polyethylene or polypropylene in a conventional manner. Where hinge-lid packs of smoking articles are over wrapped, the over wrapper may include a tear tape.

The invention will be further described, by way of example only, with reference to the accompanying drawings in which.

Figure 1:
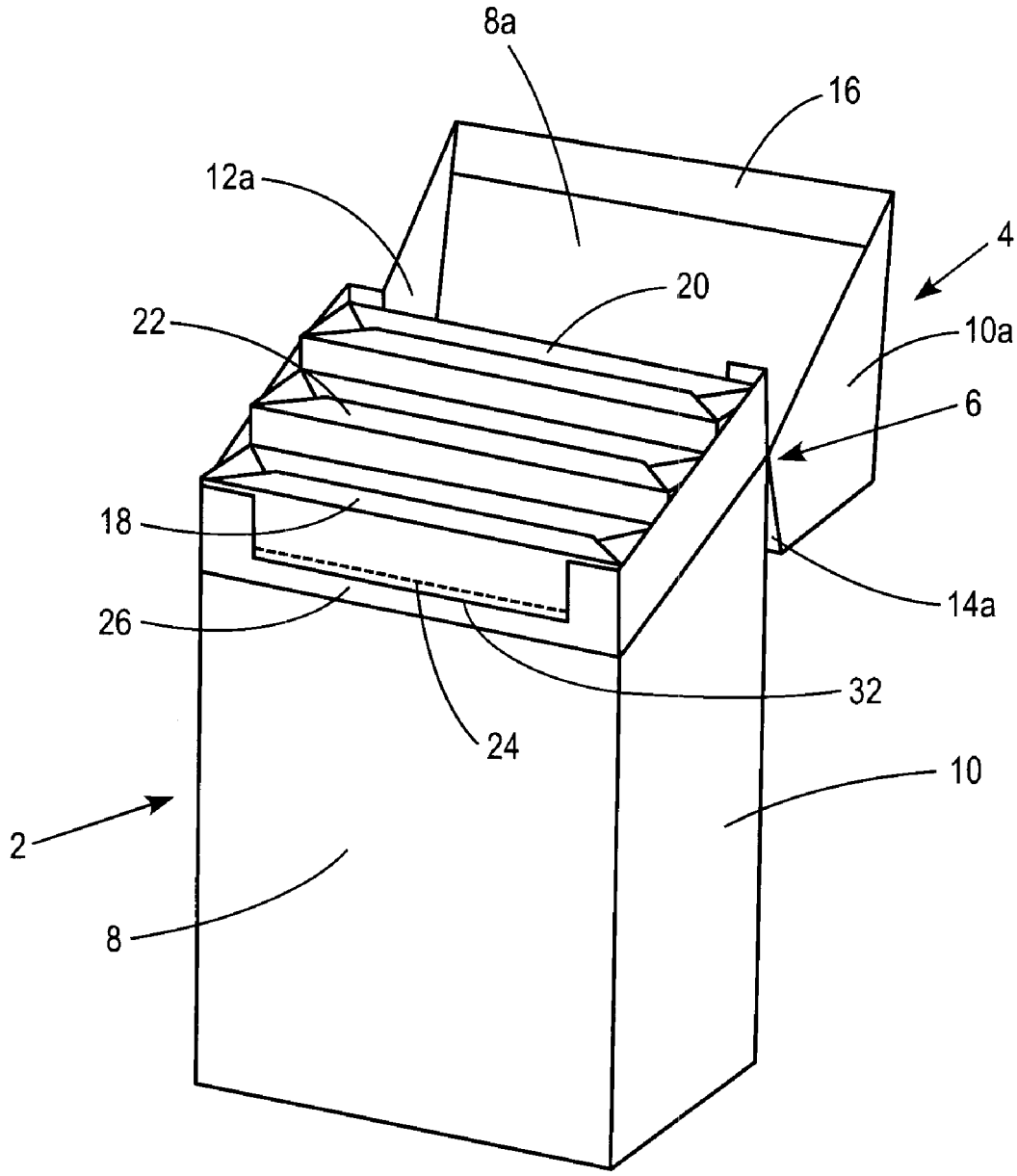
FIG. 1 is a front perspective view of an open hinge-lid pack of cigarettes according to a first embodiment of the invention.

The hinge-lid pack of cigarettes according to a first embodiment of the invention shown in FIG. 1 is a rectangular parallelepiped and generally comprises a lower box portion 2 and an upper lid portion 4, which is hinged to the lower box portion along a horizontal hinge line 6 that extends across the rear of the pack. The lower box portion 2 and the upper lid portion have the same general construction as the box portion and the lid portion of a conventional hinge-lid cigarette pack having right-angled vertical edges and right-angled horizontal edges.

The lower box portion 2 has a front wall 8, a right side wall 10, a left side wall, a rear wall and a bottom wall. The upper lid portion 4 similarly has a front wall 8*a*, right side wall 10*a*, left side wall 12*a* and a rear wall 14*a*, which function respectively as continuations of the corresponding similarly numbered walls of the lower box portion 2 when the box portion 2 and lid portion 4 are pivoted about the hinge line 6 from the open position shown in FIG. 1 to a closed position. The upper lid portion 4 of the hinge-lid pack further includes a top wall, which opposes the bottom wall of the lower box portion 2 when the upper lid portion 4 is in the closed position, and an inner flap 16, which extends from the front wall 8*a* of the upper lid portion 2 and is affixed to the inner surface thereof.

As shown in FIG. 1, three tiers of cigarettes are mounted in the lower box portion 2: a lowermost tier 18, adjacent the front wall 8 of the lower box portion 2, an uppermost tier 20, adjacent the rear wall 8 of the lower box portion 2, and a central or middle tier 22, positioned between the lowermost tier 18 and the uppermost tier 20. Each tier 18, 20 and 22 comprises a row of seven cigarettes (not shown) wrapped in a folded sheet of metal foil or metalized paper. The hinge-lid pack shown in FIG. 1 thus contains a total of twenty one cigarettes arranged in three separately wrapped, stepped, parallel rows. A line of weakness 24 provided in the sheet of metal foil or metalized paper (shown by a broken line in FIG. 1), extends around each tier 18, 20 and 22, proximate the upper end of the row of seven cigarettes. The line of weakness may be formed by stamping, scoring, perforating, embossing or otherwise compressing, cutting and/or weakening the sheet of metal foil or metalized paper prior to folding.

Figure 2:
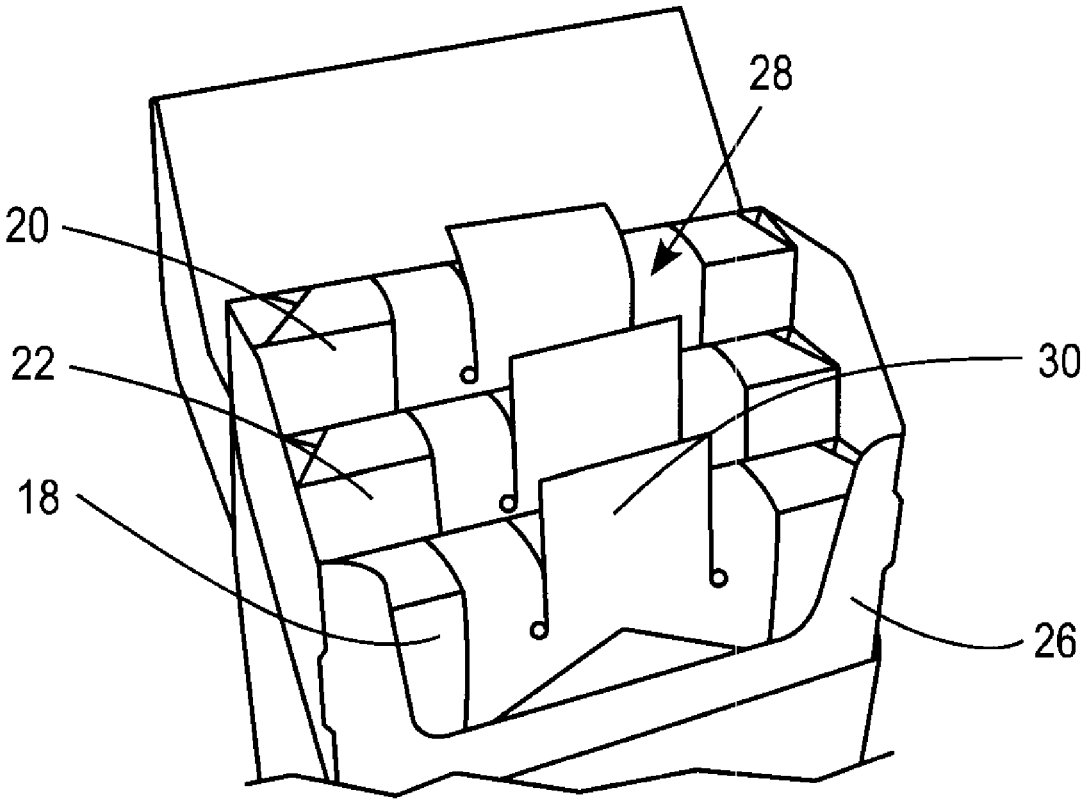
FIG. 2 shows an enlarged view of the tiers of smoking articles in the hinge-lid pack of cigarettes of FIG. 1.

As shown in FIG. 2, each tier 18, 20, 22 further comprises a self-adhesive outer label 28, which extends from the upper end of the front wall of the folded metal foil or metalized paper wrapper over the upper end of the row of seven cigarettes to the upper end of the rear wall of the wrapper. For the sake of simplicity, the self-adhesive outer labels 28 have been omitted from FIG. 1. The outer label 28 is provided with a non-adhesive tab 30 that projects upwardly there from, away from the wrapped row of cigarettes. In use, the consumer pulls on this tab 30 in order to separate the folded sheet of metal foil or metalized paper along the line of weakness 24 therein and so remove the upper portion of the wrapper from the row of cigarettes in that tier. Until the upper portion of the wrapper is removed by the consumer in order to gain access to the upper ends of the seven cigarettes enveloped therein, the outer label 28 advantageously helps to keep the upper folded end of the wrapper closed. If desired, the tabs 30 and/or outer labels 28 on each of the three tiers 18, 20, 22 may be of, for example, a different size, color or shape.

The hinge-lid pack of cigarettes shown in FIG. 1 further comprises an inner frame 26 having a front wall, a right side wall, a left side wall, a right rear wall flap and a left rear wall flap. The inner frame 26 is mounted in the lower box portion 2, between the lower box portion 2 and the three tiers of cigarettes 18, 20 and 22, so that an upper portion thereof extends from the lower body portion 2 into the space covered by the upper lid portion 4 when in the closed position. If desired, the inner flap 16 of the upper lid portion 4 may be provided with known retention means that, in use, cooperate with the walls of and/or further known retention means provided on the inner frame 26 of the hinge-lid pack (not shown) to help retain the upper lid portion 4 in the closed position with the lower edges of the walls thereof abutting the upper edges of the walls of the lower box portion.

In FIG. 1, the line of weakness 24 extending around the lowermost tier 18 is visible through a central cut-out provided in the front wall of the inner frame 26. Preferably, however, the position of the line of weakness 24 in the sheet of metal foil or metalized paper of the lowermost tier 18 is such that the line of weakness is positioned below the bottom edge 32 of the central cut-out in the inner frame 26, so that it is not visible to the consumer upon opening the pack.

To form hinge-lid pack of cigarettes of the type shown in FIG. 1, rows of seven cigarettes are formed and wrapped by folding a sheet of metal foil or metalized paper about each row in a conventional manner. The separately wrapped rows of seven cigarettes are then collected in groups of three, longitudinally offset relative to one another to form the three tiers 18, 20, 22 shown in FIG. 1 and affixed together using an adhesive. The three tiers 18, 20, 22 are then placed together with the inner frame 26, which is affixed to the three tiers 18, 20, 22 with adhesive, in a pocket on a wrapping wheel that is indexable between a number of stations. Prior to insertion of the three tiers 18, 20, 22 and inner frame 26, the pocket is lined with a laminar cardboard blank including various panels and flaps, which when folded about appropriate score lines form the box portion 2 and the lid portion 4 of the hinge-lid pack shown in FIG. 1. As the wrapping wheel indexes around from station to station, the laminar blank is folded in stages around the three tiers 18, 20, 22 of cigarettes and the inner frame 26 to form the hinge-lid pack in a known manner using conventional machinery. The inner frame 26 may be affixed to the inside of the box portion 2 of the hinge-lid pack by, for example, the application of a suitable adhesive to the outer surface of the sides of the inner frame and/or the application of a suitable adhesive to the inner surface of the panels of the blank that, when folded, form the side walls of the box portion of the hinge-lid pack.

Figure 3:
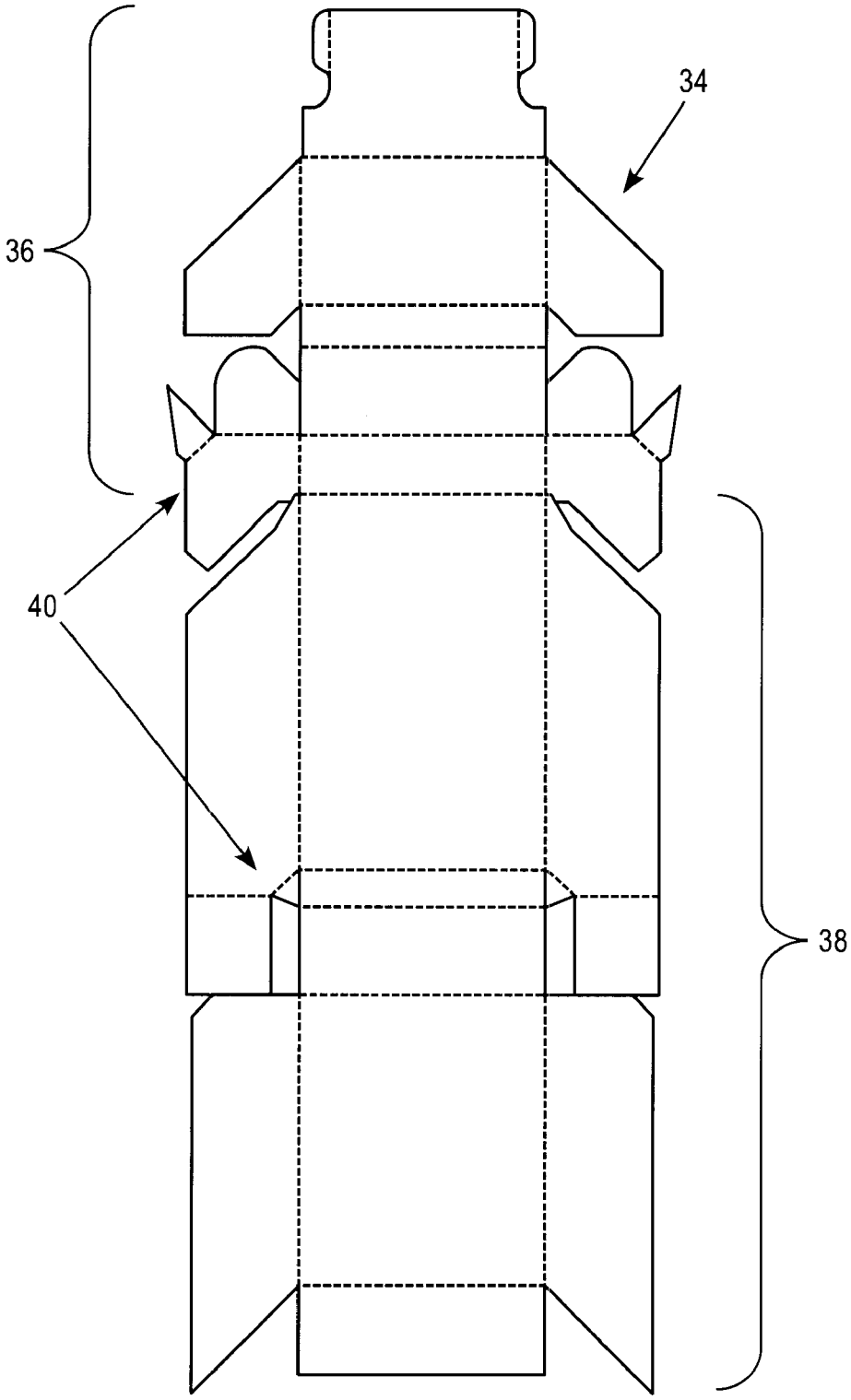
FIG. 3 is a plan view of a laminar blank for forming a hinge-lid container according to a second embodiment of the invention.

FIG. 3 shows an elongate, laminar cardboard blank 34 for forming the lid portion and box portion of a hinge-lid pack of cigarettes according to a second embodiment of the invention. The blank 34 includes various panels and flaps 36, 38, which when folded about appropriate score lines (shown by broken lines in FIG. 3) form the upper lid portion and lower box portion, respectively of a hinge-lid pack of cigarettes according to a second embodiment of the invention. The lid portion and box portion of the hinge-lid pack of cigarettes formed from the blank 34 shown in FIG. 3 are of largely similar construction to the lid portion 4 and box portion 2 of the hinge-lid pack of cigarettes according to the first embodiment of the invention shown in FIG. 1. However, in the hinge-lid pack of cigarettes according to the second embodiment of the invention, the bottom rear edge of the box portion, which joins the rear wall of the box portion to the bottom wall thereof, and the upper front edge of the lid portion, which joins the front wall of the lid portion to the top wall thereof, are both beveled. As shown in FIG. 3, the blank 34 further comprises dust flaps 40. When the blank 34 is folded, these dust flaps 40 avoid the formation of 'holes' in the hinge-lid pack through which, in use, strands of loose tobacco from the cigarettes could escape.

A hinge-lid container according to the second embodiment of the invention is erected by folding the blank 34 shown in FIG. 3 in stages around three tiers of cigarettes and an inner frame 26 in the same manner previously described to erect the hinge-lid pack of cigarettes according to the first embodiment of the invention shown in FIG. 1.

Figure 4:
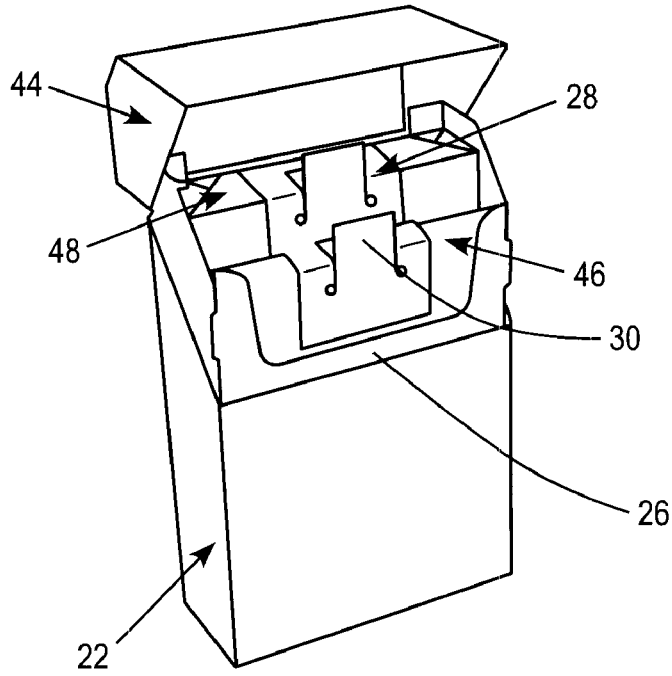
FIG. 4 is a front perspective view of an open hinge-lid pack of cigarettes according to a third embodiment of the invention.
Figure 5:
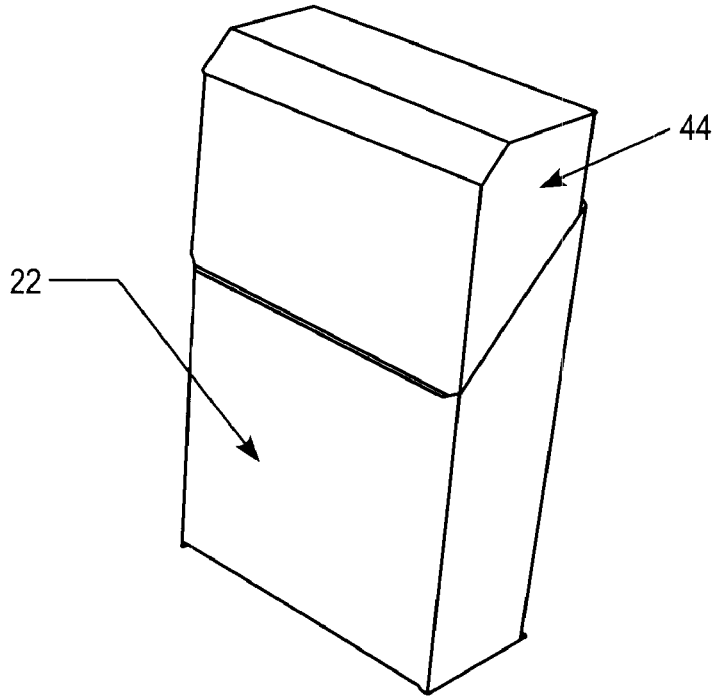
FIG. 5 is a front perspective view of the hinge-lid pack of FIG. 4 with the lid closed.

FIGS. 4 and 5 show a hinge-lid pack of cigarettes according to a third embodiment of the invention comprising a lower box portion 42 and an upper lid portion 44, which are of largely similar construction to the lower box portion 2 and upper lid portion 4 of the hinge-lid pack of cigarettes according to the first embodiment of the invention shown in FIG. 1. However, as shown in FIG. 5, in the hinge-lid pack of cigarettes according to the third embodiment of the invention, the upper front edge of the lid portion 44, which joins the front wall of the lid portion 44 to the top wall thereof, is beveled.

As shown in FIG. 4, two tiers of cigarettes are mounted in the lower box portion 42: a lowermost tier 46, adjacent the front wall of the lower box portion 42, and an uppermost tier 48, adjacent the rear wall of the lower box portion 42. The uppermost tier 48 comprises a bundle of thirteen king size cigarettes (not shown), arranged in two parallel nested rows in a 7-6 collation, wrapped in a folded sheet of metal foil or metalized paper. The lowermost tier 46 comprises a row of seven shorter cigarettes (not shown) wrapped in a folded sheet of metal foil or metalized paper. The hinge-lid pack shown in FIG. 4 thus contains a total of twenty cigarettes.

As in the first embodiment of the inventions shown in FIG. 1, a line of weakness (not shown) provided in the sheet of metal foil or metalized paper, extends around each of the two tiers 48, 48, proximate the upper end of the cigarettes. In addition, as previously described, each of the two tiers 46, 48 further comprises a self-adhesive outer label 28, provided with an upwardly projecting non-adhesive tab 30, which extends from the upper end of the front wall of the folded metal foil or metalized paper wrapper over the upper end of the cigarettes to the upper end of the rear wall of the wrapper.

The hinge-lid pack of cigarettes shown in FIGS. 4 and 5, which also further comprises an inner frame 26, may be formed in a manner similar to that previously described above for the hinge-lid pack of cigarettes according to the first embodiment of the invention shown in FIGS. 1 and 2. The separately wrapped bundle of thirteen king size cigarettes and the separately wrapped row of seven shorter cigarettes are, however, affixed together using an adhesive with the lower ends of the king size cigarettes and shorter cigarettes therein longitudinally aligned. Due to the difference in length of the cigarettes, this results in the upper ends of the lowermost tier 46 and the uppermost tier 48 being longitudinally offset relative to one another as shown in FIG. 4.

Advantageously, the overall height of the hinge-lid pack of cigarettes according to the third embodiment of the invention shown in FIGS. 4 and 5 is thus substantially the same as that of a conventional hinge-lid cigarette pack, about 88 mm.

The hinge-lid packs of smoking articles according to the first, second and third embodiments of the invention may be shrink wrapped or otherwise over wrapped with a transparent polymeric film of, for example, polyethylene or polypropylene in a conventional manner. Where hinge-lid packs according to the invention are over wrapped, the over wrapper preferably includes a tear tape, more preferably a tear tape extending longitudinally around the pack; conventionally tear tapes in over wrappers for hinge-lid packs of cigarettes extend transversely around the packs.

While the hinge-lid pack of cigarettes according to the first embodiment of the invention shown in FIG. 1 comprises three tiers of cigarettes, each tier containing a single row of seven cigarettes, and the hinge-lid pack of cigarettes according to the third embodiment of the invention shown in FIG. 4 comprises two tiers of cigarettes, one tier comprising a bundle of thirteen cigarettes and the other tier comprising a single row of seven cigarettes, it will be appreciated that hinge-lid packs according to the invention containing different number of tiers of smoking articles, different numbers of smoking articles in each tier and/or different types of smoking articles in each tier may be similarly produced.

It will be appreciated from the foregoing description that the present invention advantageously provides a novel hinge lid pack of smoking articles comprising: a lower box portion; an upper lid portion connected to the lower box portion along a hinge line extending across a rear wall of the hinge-lid pack; and at least two longitudinally offset separately wrapped bundles of smoking articles mounted in the lower box portion.

The invention claimed is:

1. A hinge lid pack of smoking articles comprising:

a lower box portion;

an upper lid portion connected to the lower box portion along a hinge line extending across a rear wall of the hinge-lid pack; and at least two longitudinally offset tiers of smoking articles mounted in the lower box portion, wherein each of the at least two tiers comprises a separately wrapped bundle of smoking articles, wherein each of the at least two tiers comprises a frontal upstanding tab affixed to an upper end of a front wall of the separately wrapped bundle of smoking articles with a clearance between frontal upstanding tabs and the upper lid portion via the longitudinally offset tiers and wherein the frontal upstanding tab is part of a label that extends over the upper end of the separately wrapped bundle of smoking articles.

2. The hinge-lid pack of smoking articles according to claim 1, wherein the at least two tiers of smoking articles are formed by affixing at least two separately wrapped bundles of elongate smoking articles to one another in a longitudinally offset relationship.

3. The hinge-lid pack of smoking articles according to claim 1, wherein the smoking articles in each of the at least two tiers are of substantially the same length and the upper ends and the lower ends of the separately wrapped bundles of smoking articles are longitudinally offset relative to one another.

4. The hinge-lid pack of smoking articles according to claim 1, wherein the smoking articles in each of the at least two tiers are of different length and the upper ends of the separately wrapped bundles of smoking articles are longitudinally offset relative to one another.

5. The hinge-lid pack of smoking articles according to claim 1, further comprising an inner frame mounted in the lower box portion, between the lower box portion and the at least two tiers of smoking articles.

6. The hinge-lid pack of smoking articles according to claim 5, wherein the inner frame is affixed to the lower box portion.

7. The hinge-lid pack of smoking articles according to claim 5, wherein one or more of the at least two tiers of smoking articles is affixed to the inner frame.

8. The hinge-lid pack of smoking articles according to claim 1, having an uppermost tier of smoking articles adjacent to a rear wall of the lower box portion and a lowermost tier of smoking articles adjacent to a front wall of the lower box portion.

9. The hinge-lid pack of smoking articles according to claim 1, wherein each of the at least two tiers comprises a bundle of smoking articles enveloped in a wrapper having a line of weakness.

10. The hinge-lid pack of smoking articles according to claim 9, wherein the line of weakness extends circumferentially around an upper region of the separately wrapped bundle of smoking articles.

11. The hinge-lid pack of smoking articles according to claim 1, wherein each of the at least two tiers comprises a bundle of smoking articles wrapped in a folded sheet of metal foil or metalized paper.

12. The hinge-lid pack of smoking articles according to claim 1, comprising three longitudinally offset tiers of smoking articles.

13. The hinge-lid pack of smoking articles according to claim 1, wherein a bottom rear edge of the box portion, which joins a rear wall of the box portion to a bottom wall thereof, and an upper front wall of the lid portion to a top wall portion thereof, are both beveled.

14. The hinge-lid pack of smoking articles according to claim 1, wherein an upper front edge of the lid portion, which joins a front wall of the lid portion to a top wall of the lid portion, is beveled.

15. The hinge-lid pack of smoking articles according to claim 10, wherein the line of weakness is formed by stamping, scoring, perforating, embossing or otherwise compressing, cutting and/or weakening of the wrapper.

16. A hinge lid pack of smoking articles comprising:

a lower box portion;

an upper lid portion connected to the lower box portion along a hinge line extending across a rear wall of the hinge-lid pack, and wherein an upper front edge of the lid portion, which joins a front wall of the lid portion to a top wall of the lid portion, is beveled; and at least two longitudinally offset tiers of smoking articles mounted in the lower box portion;

wherein each of the at least two tiers comprises a separately wrapped bundle of smoking articles, wherein each of the at least two tiers comprises a frontal upstanding tab affixed to an upper end of a front wall of the separately wrapped bundle of smoking articles with a clearance between frontal upstanding tabs and the upper lid portion via the longitudinally offset tiers and wherein the frontal upstanding tab is part of a label that extends over the upper end of the separately wrapped bundle of smoking articles.

17. The hinge-lid pack of smoking articles according to claim 16, wherein the at least two tiers of smoking articles are formed by affixing at least two separately wrapped bundles of elongate smoking articles to one another in a longitudinally offset relationship.

18. The hinge-lid pack of smoking articles according to claim 16, wherein the smoking articles in each of the at least two tiers are of substantially the same length and the upper ends and the lower ends of the separately wrapped bundles of smoking articles are longitudinally offset relative to one another.

19. The hinge-lid pack of smoking articles according to claim 16, wherein the smoking articles in each of the at least two tiers are of different length and the upper ends of the separately wrapped bundles of smoking articles are longitudinally offset relative to one another.

20. The hinge-lid pack of smoking articles according to claim 10, wherein the line of weakness in the wrapper of a bundle of the lowermost tier is visible through a central cut-out provided in the front wall of the inner frame.

21. The hinge-lid pack of smoking articles according to claim 20, wherein the line of weakness in the wrapper of a bundle of the lowermost tier is such that the line of weakness is positioned below a bottom edge of the central cut-out in the inner frame.

* * * * *